US011703218B2

(12) United States Patent
Hase

(10) Patent No.: US 11,703,218 B2
(45) Date of Patent: Jul. 18, 2023

(54) BURNER ARRANGEMENT HAVING A PERIPHERAL STAGING CONCEPT

(71) Applicant: Siemens Energy Global GmbH & Co. KG, Munich (DE)

(72) Inventor: Matthias Hase, Mulheim (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 937 days.

(21) Appl. No.: 16/470,220

(22) PCT Filed: Jan. 25, 2018

(86) PCT No.: PCT/EP2018/051848
§ 371 (c)(1),
(2) Date: Jun. 16, 2019

(87) PCT Pub. No.: WO2018/141627
PCT Pub. Date: Aug. 9, 2018

(65) Prior Publication Data

US 2019/0368725 A1 Dec. 5, 2019

(30) Foreign Application Priority Data

Feb. 3, 2017 (DE) ..... 10 2017 201 771.6

(51) Int. Cl.
*F23R 3/34* (2006.01)
*F23D 11/24* (2006.01)
*F23R 3/28* (2006.01)

(52) U.S. Cl.
CPC ..... *F23D 11/24* (2013.01); *F23R 3/286* (2013.01); *F23R 3/34* (2013.01); *F23D 2209/20* (2013.01); *F23N 2241/20* (2020.01); *F23R 2900/00005* (2013.01); *F23R 2900/00014* (2013.01)

(58) Field of Classification Search
CPC ..... F23R 3/286; F23R 3/34
See application file for complete search history.

(56) References Cited

U.S. PATENT DOCUMENTS 5,289,685 A * 3/1994 Hoffa ..... F02C 7/222 60/746
5,481,867 A 1/1996 Dubell et al.
2002/0162336 A1 11/2002 Weisenstein
(Continued)

FOREIGN PATENT DOCUMENTS

CN 101799162 A * 8/2010 ..... F23R 3/10
CN 105899878 A * 8/2016 ..... F23C 7/008
(Continued)

OTHER PUBLICATIONS

PCT International Search Report and Written Opinion of International Searching Authority dated May 23, 2018 corresponding to PCT International Application No. PCT/EP2018/051848 filed 2018, Jan. 25, 2018.

*Primary Examiner* — Arun Goyal

(57) ABSTRACT

A burner arrangement has a plurality of mixing channels which extend parallel to the main axis of the burner arrangement and are arranged in at least two concentric circles, in which mixing channels fuel and discharge air from the compressor are mixed during the operation of the burner arrangement. The mixing channels are grouped together into fuel stages so as to produce an irregular staging in the peripheral direction of the burner arrangement.

5 Claims, 1 Drawing Sheet

(56) References Cited

U.S. PATENT DOCUMENTS

| | | | | |
|---|---|---|---|---|
| 2003/0106321 | A1 | 6/2003 | Von Der Bank | |
| 2008/0083841 | A1 | 4/2008 | Bainville et al. | |
| 2009/0241548 | A1* | 10/2009 | Danis ..... | F23R 3/50 60/747 |
| 2013/0152597 | A1 | 6/2013 | Durbin et al. | |
| 2016/0209040 | A1 | 7/2016 | Tamura et al. | |

FOREIGN PATENT DOCUMENTS

| | | | |
|---|---|---|---|
| DE | 3924464 | A1 | 7/1997 |
| DE | 10160997 | A1 | 7/2003 |
| DE | 102004015186 | A1 | 10/2005 |
| DE | 112009000719 | T5 | 2/2011 |
| EP | 1255074 | A1 | 11/2002 |
| WO | 2005093326 | A2 | 10/2005 |
| WO | 2015176908 | A1 | 11/2015 |

* cited by examiner

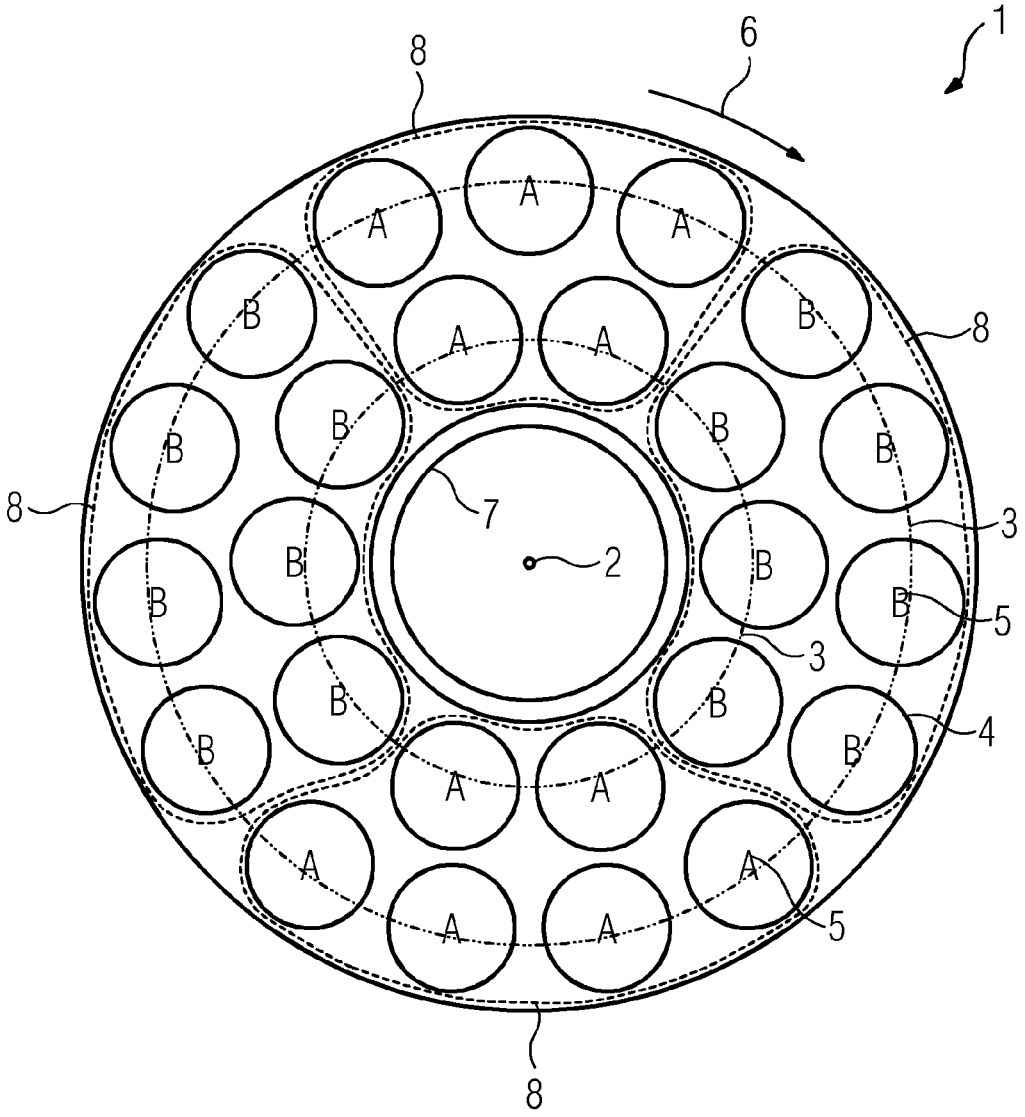
1
6
8
A
B
7
2
3
5
4

BURNER ARRANGEMENT HAVING A PERIPHERAL STAGING CONCEPT

CROSS REFERENCE TO RELATED APPLICATIONS

This application is the US National Stage of International Application No. PCT/EP2018/051848 filed Jan. 25, 2018, and claims the benefit thereof. The International Application claims the benefit of German Application No. DE 10 2017 201 771.6 filed Feb. 3, 2017. All of the applications are incorporated by reference herein in their entirety.

FIELD OF INVENTION

The invention relates to a burner arrangement having mixing channels, in which discharge air from the compressor and fuel are premixed before they are injected into a combustion chamber as a fuel/air mixture.

BACKGROUND OF INVENTION

WO 2015/176908 A1 discloses a burner arrangement of this kind, which comprises a nozzle carrier having a hot side facing a combustion zone during operation and an opposite cold side facing away from the combustion zone, wherein passages in the nozzle carrier extend from the cold side to the hot side, i.e. parallel to the main axis of the burner arrangement, each having an inlet on the cold side and an outlet on the hot side. The passages serve as jet nozzles, which are arranged in one or more circles, e.g. in two fuel groups, each comprising one group in a circle, and at the inlet side of which fuel lances are arranged. The two jet burner stages formed by the fuel groups are each distributed in a substantially uniform manner over the circumference as regards the flame temperature since the fuel is uniformly distributed. It is only due to relatively slight nonuniformity in the air distribution that relatively small differences in the flame temperatures arise.

During burner operation, problems can arise with high-frequency vibrations (HFD), which limit the achievable operating range of the burner arrangement, the problems including a failure by the machine to reach the base load or the occurrence of a rapid machine shutdown. In the worst case, there is damage to the gas turbine within a short time.

This problem can be reduced at least somewhat by the use of Helmholtz resonators, but has not yet been completely resolved.

SUMMARY OF INVENTION

It is therefore an object of the invention to provide a burner arrangement of the type stated at the outset which has improved behavior in respect of high-frequency vibrations.

The invention achieves the object as it relates to a burner arrangement by making provision that, in a burner arrangement of this kind having a plurality of mixing channels, which extend parallel to the main axis of the burner arrangement and are arranged in at least two concentric circles, in which mixing channels fuel and discharge air from the compressor are mixed during the operation of the burner arrangement, the mixing channels are grouped together into fuel stages, wherein a fuel stage comprises mixing channels with a common fuel supply, which are controlled jointly during operation, and wherein irregular staging in the peripheral direction of the burner arrangement is obtained in respect of the geometric distribution of the mixing channels associated with the respective fuel stages.

Thus, instead of the radial staging disclosed in the prior art, the invention provides peripheral staging for the burner arrangement. This enables the flame temperature to be varied slightly over the circumference, effectively suppressing the formation of the HFD dynamics which typically arise with a circumferential mode component. It is important in this context that the staging is embodied in such a way that there is no regularity of the type AABB over the circumference (A and B are nozzles or groups of nozzles with a common fuel supply). In addition, it can be expected that the staging proposed will also allow more stable operation of the burner arrangement to counteract flame loss during loading.

It is expedient if the burner arrangement comprises a centrally arranged pilot burner in order to stabilize the combustion of the fuel/air mixture supplied by the mixing channels.

In an advantageous embodiment of the invention, a fuel stage comprises at least two subgroups, which, in turn, comprise at least two directly adjacent mixing channels in different circles. The formation of subgroups ensures that the flames of the respective mixing channels stabilize each other during operation. In particular, there is stabilization of combustion by the entire burner arrangement, starting from the central pilot, via an inner circle, at mixing channels further out. The grouping of subgroups allows moderate asymmetry in the distribution of the fuel supply over the circumference of the burner arrangement without the need to define an unnecessarily large number of fuel stages, which are in any case operated only jointly, i.e. in groups. As a result, the loading of downstream components remains relatively uniform, and high-frequency vibrations can in this way be limited very well.

It is furthermore advantageous if a number of mixing channels in a circle within a subgroup is no more than twice a number of mixing channels in another circle. This ensures that a ratio of the number of mixing channels of the individual subgroups is appropriately distributed over the entire burner arrangement in order to guarantee a maximum possible combustion stability at all points.

It is furthermore advantageous if the subgroups in at least one fuel stage have a different number of mixing channels from each other. This asymmetry contributes to the avoidance of high-frequency combustion vibrations.

Finally, it is expedient if the number of mixing channels in one fuel stage exceeds the number of mixing channels of another fuel stage by no more than 50% to enable the loading of downstream components due to adaptations of the fuel distribution to the individual fuel stages to be kept as low as possible over the entire burner arrangement in order to avoid combustion vibrations.

BRIEF DESCRIPTION OF THE DRAWINGS

The invention is explained in greater detail by way of example by means of the FIGURE.

DETAILED DESCRIPTION OF INVENTION

The FIGURE, which is schematic and not to scale, shows a burner arrangement 1 having a plurality of mixing channels 4, which extend parallel to the main axis 2 of the burner arrangement 1 and are arranged in at least two concentric circles 3, in which mixing channels fuel and discharge air from the compressor are mixed during the operation of the burner arrangement 1. According to the invention, the mixing channels 4 are grouped in such a way into fuel stages 5, which are denoted by A and B in the FIGURE, that irregular staging is obtained in the peripheral direction 6 of the burner arrangement 1. The FIGURE shows just one example but the principle of fuel staging over the periphery can be applied to any desired number of mixing channels 4 and it is immaterial here whether there is an even or an odd number of mixing channels 4. The number of circles 3 in which the mixing channels 4 are arranged can also vary. In principle, the burner arrangement 1 can also have more than two premixed fuel stages 5 (A and B), but this is not worthwhile owing to cost considerations.

The burner arrangement 1 includes a centrally arranged pilot burner 7 in order to stabilize the combustion of the fuel/air mixture supplied by the mixing channels 4.

The illustrative embodiment in the FIGURE shows that the mixing channels 4 of the fuel stages 5, which are denoted by A and B, are distributed nonuniformly over the periphery. In this arrangement, at least two adjacent mixing channels 4 from the inner and the outer circle 3 always form a subgroup 8 of the respective fuel stage 5 (A or B). These two mixing channels 4 are supplemented by additional mixing channels 4 of the inner and/or outer circle 3, wherein the subgroups 8 do not contain significantly more mixing channels 4 from a circle 3.

A fuel stage 5 can comprise two, three or more subgroups 8 with differing numbers of mixing channels 4, there being two subgroups 8 per fuel stage 5 in the example shown in the FIGURE.

Furthermore, the FIGURE shows that not all the subgroups 8 have the same number of mixing channels 4, this being regarded as advantageous in respect of the irregularity to be achieved.

Irregularities in respect of the arrangement and number of mixing channels are desired but should not be maximized. In particular, care should be taken to ensure that, as far as possible, the fuel stages 5 have the same number of mixing channels 4 in order to ensure stable combustion as regards flame loss.

The invention claimed is:

1. A burner arrangement of a gas turbine combustor, comprising:

a plurality of mixing channels, which extend parallel to a main axis of the burner arrangement and are arranged in at least two concentric circles, in the plurality of mixing channels fuel and discharge air from a compressor are mixed during operation of the burner arrangement, wherein the plurality of mixing channels are grouped together into fuel stages, wherein a fuel stage of the fuel stages comprises a portion of the plurality of mixing channels with a common fuel supply, which are controlled jointly during operation, and irregular staging in a circumferential direction of the burner arrangement is obtained in respect of a geometric distribution of the plurality of mixing channels associated with each of the fuel stages, wherein the fuel stage comprises different number of the plurality of mixing channels than in a different fuel stage of the fuel stages, wherein the common fuel supply in the fuel stage is different than a common fuel supply in the different fuel stage of the fuel stages, wherein the fuel stage comprises at least two subgroups, wherein each subgroup of the at least two subgroups comprises at least two directly adjacent mixing channels of the plurality of mixing channels in two different circles of the at least two concentric circles, wherein each subgroup of the at least two subgroups comprises different number of the plurality of mixing channels in each of the two different circles.

2. The burner arrangement as claimed in claim 1, further comprising:

a centrally arranged pilot burner.

3. The burner arrangement as claimed in claim 1, wherein a first number of the plurality of mixing channels in a circle of the at least two concentric circles within one subgroup of the at least two subgroups is no more than twice a second number of the plurality of mixing channels in another circle of the at least two concentric circles of the one subgroup.

4. The burner arrangement as claimed in claim 1, wherein the subgroups in at least one of the fuel stages have different numbers of the plurality of mixing channels from each other.

5. The burner arrangement as claimed in claim 1, wherein a first number of the plurality of mixing channels in one of the fuel stages exceeds a second number of the plurality of mixing channels of another of the fuel stages different from the one of the fuel stages by no more than 50%.

* * * * *